US007096888B1

(12) United States Patent
Thurston et al.

(10) Patent No.: US 7,096,888 B1
(45) Date of Patent: Aug. 29, 2006

(54) FLUIDIC PULSE GENERATOR SYSTEM

(75) Inventors: John F. Thurston, Mesa, AZ (US); William F. Ryan, Phoenix, AZ (US)

(73) Assignee: Honeywell International, Inc., Morristown, NJ (US)

( * ) Notice: Subject to any disclaimer, the term of this patent is extended or adjusted under 35 U.S.C. 154(b) by 315 days.

(21) Appl. No.: 10/783,744

(22) Filed: Feb. 20, 2004

Related U.S. Application Data

(60) Provisional application No. 60/525,397, filed on Nov. 26, 2003.

(51) Int. Cl.
*F15C 1/12* (2006.01)
*F15C 1/14* (2006.01)

(52) U.S. Cl. ..... 137/818; 137/815; 137/826; 137/831; 137/338; 137/899.2

(58) Field of Classification Search ..... 137/815, 137/818, 826, 831, 338, 899.2
See application file for complete search history.

(56) References Cited

U.S. PATENT DOCUMENTS 3,175,569 A 3/1965 Sowers, III
3,199,782 A 8/1965 Shinn
3,232,305 A * 2/1966 Groeber ..... 137/817
3,266,510 A * 8/1966 Wadey ..... 137/836
3,289,687 A 12/1966 Dunaway
3,333,598 A 8/1967 Bottone, Jr.
3,357,441 A 12/1967 Adams
3,467,125 A * 9/1969 Dexter ..... 137/816
3,474,805 A * 10/1969 Swartz ..... 137/1
3,499,460 A 3/1970 Rainer
3,552,114 A * 1/1971 Sutton ..... 57/246
3,581,757 A 6/1971 Pavlin et al.
3,584,635 A * 6/1971 Warren ..... 137/817
3,877,488 A 4/1975 Merrell et al.
4,194,095 A 3/1980 Doi et al.
4,291,395 A 9/1981 Holmes
4,445,377 A 5/1984 Tippetts
4,678,009 A 7/1987 Mon
5,067,509 A 11/1991 Hunter
5,893,383 A 4/1999 Facteau
6,308,898 B1 10/2001 Dorris, III et al.

OTHER PUBLICATIONS

Active Core Exhaust Control. Sealcon The Thing that works. [online] DUPONT the miracles of science. [retrieved on Feb. 5, 2004]. Retrieved from Internet: <URL:www.afrlhorizons.com/Briefs /0001/VA9905.html>.

Propulsion Intergration (VAAI Branch). Air Vehicles Directorate. [online] U.S. Air Force. [retrieved on Feb. 5, 2004]. Retrieved from Internet: <URL: www.va.afrl.af.mil/DIV/VAA/VAAI/propulsion_index.html>.

* cited by examiner

*Primary Examiner*—A. Michael Chambers

(57) ABSTRACT

A fluidic pulse generator system includes two fluidic diverter valves that are both controlled by a single fluidic pilot valve. The fluidic pilot valve and the two fluidic diverter valves are each adapted to receive a flow of pressurized fluid. The flow of pressurized fluid through the fluidic pilot valve is controlled in response to pressurized fluid flow through a control valve. In turn, the flow of pressurized fluid through the two fluidic diverters valves is simultaneously controlled in response to the flow of pressurized fluid through the fluidic pilot valve.

20 Claims, 2 Drawing Sheets

FLUIDIC PULSE GENERATOR SYSTEM

CROSS-REFERENCE TO RELATED APPLICATIONS

This application claims the benefit of U.S. Provisional Application No. 60/525,397, filed Nov. 26, 2003.

STATEMENT REGARDING FEDERALLY SPONSORED RESEARCH OR DEVELOPMENT

This invention was made with Government support under Agreement No. F33615-95-D-3217 awarded by the U.S. Air Force. The Government may have certain rights in this invention.

FIELD OF THE INVENTION

The present invention relates to a fluid pressure pulse generating system and, more particularly, to a fluidic pulse generator system that uses fluidic bistable amplifiers configured to operate as diverter valves.

BACKGROUND OF THE INVENTION

Many aircraft include jet engines, such as turbojet and turbofan jet engines, to provide thrust to move the aircraft, both in flight and on the ground. Generally, when an aircraft is on the ground and not moving, even for relatively short periods, the engines are turned off. However, in some instances, it may be desirable to keep the engines running. For example, in some military contexts, it may be desirable to land an aircraft only long enough to load, or reload, the aircraft with various equipment, supplies, and/or personnel. In such instances, it may be desirable to cool the engine exhaust to a level at or below a particular value, to alleviate discomfort for ground personnel.

The exhaust from turbojet and turbofan engines can be quite hot and noisy. If the jet engine is positioned relative to the airframe such that the hot exhaust impinges on the airframe, the hot exhaust can cause undesirable temperature-induced effects on the material properties of the impinged parts. As a result, the impinged parts may need to be constructed of one or more materials that can withstand high temperatures. This can lead to increased costs. In some cases, even such high-temperature materials may not be sufficient, and thus steps must be taken to prevent impingement or to mitigate the effect of impingement.

A number of different approaches have been used to prevent impingement, or to mitigate, jet engine exhaust gas impingement on airframe surfaces. One attempted solution is to forcibly mix the turbine engine core exhaust with relatively lower-temperature fan bypass air prior to exhausting the mixed exhaust stream out the back end of the engine, so that the resulting exhaust stream has a lower temperature. Another attempted solution is to include a core exhaust thrust reverser that can be selectively deployed and stowed. A core thrust reverser, when deployed, redirects the core exhaust outwardly and forward.

Although each of the above approaches is generally effective, each suffers certain drawbacks. For example, the forcible mixing approach may rely on a long, costly, and heavy bypass duct nacelle configuration to accommodate the mixing structure that joins and mixes the turbine exhaust and bypass air, which can potentially increase costs. Moreover, this approach can cause a reduction in overall engine efficiency. The core thrust reverser may also be a relatively heavy component, and relatively costly to manufacture and install. In addition, because the core thrust reverser includes various moving components, it can exhibit high maintainability, which can further increase overall costs.

Hence, there is a need for a system that provides jet engine exhaust cooling that is relatively lightweight, and/or relatively inexpensive to manufacture and install, and/or includes little if any moving parts, and/or provides increased reliability relative to current systems and components. The present invention addresses one or more of these needs.

SUMMARY OF THE INVENTION

The present invention provides a relatively simple, inexpensive, and robust system for supplying periodic fluid pressure pulses that may be used, for example, to cool jet engine exhaust.

In one embodiment, and by way of example only, a fluidic pulse generator system for directing a flow of a pressurized fluid includes a fluidic pilot valve, and first and second fluidic diverter valves. The fluidic pilot valve includes an inlet nozzle, first and second control ports, and first and second outlet ports. The fluidic pilot valve inlet nozzle is adapted to receive the flow of pressurized fluid, and the fluidic pilot valve first and second control ports are each adapted to selectively receive a flow of control fluid. The fluidic pilot valve is configured, in response to the selective receipt of the flow of control fluid to the fluidic pilot valve first or second control ports, to direct the flow of pressurized fluid received by the fluidic pilot valve inlet nozzle through the fluidic pilot valve second or first outlet port, respectively. The first fluidic diverter valve includes an inlet nozzle, first and second control ports, and first and second outlet ports. The first fluidic diverter valve inlet nozzle is adapted to receive the flow of pressurized fluid, and the first fluidic diverter valve first and second control ports are in fluid communication with the fluidic pilot valve second and first outlet ports, respectively. The pressurized fluid flow through the fluidic pilot valve first or second outlet ports directs the flow of pressurized fluid received by the first fluidic diverter valve inlet nozzle through the first fluidic diverter valve first or second outlet ports, respectively. The second fluidic diverter valve includes an inlet nozzle, first and second control ports, and first and second outlet ports. The second fluidic diverter valve inlet nozzle is adapted to receive the flow of pressurized fluid, and the second fluidic diverter valve first and second control ports are in fluid communication with the fluidic pilot valve second and first outlet ports, respectively. Hence, the pressurized fluid flow through the fluidic pilot valve first or second outlet ports directs the flow of pressurized fluid received by the second fluidic diverter valve inlet nozzle through the second fluidic diverter valve second or first outlet ports, respectively.

Other independent features and advantages of the preferred fluidic pressure pulse generator system will become apparent from the following detailed description, taken in conjunction with the accompanying drawings which illustrate, by way of example, the principles of the invention.

DETAILED DESCRIPTION OF A PREFERRED EMBODIMENT

Before proceeding with the detailed description, it is to be appreciated that the described embodiment is not limited to use in conjunction with a specific application. Thus, although the present embodiment is, for convenience of explanation, depicted and described as being used to provide jet engine exhaust cooling, it will be appreciated that it can be used in various other applications and systems. Some non-limiting examples of other applications and systems include providing airflow separation, or active noise control, and being used in thrust vectoring systems, or pulsed detonation systems.

Figure 1:
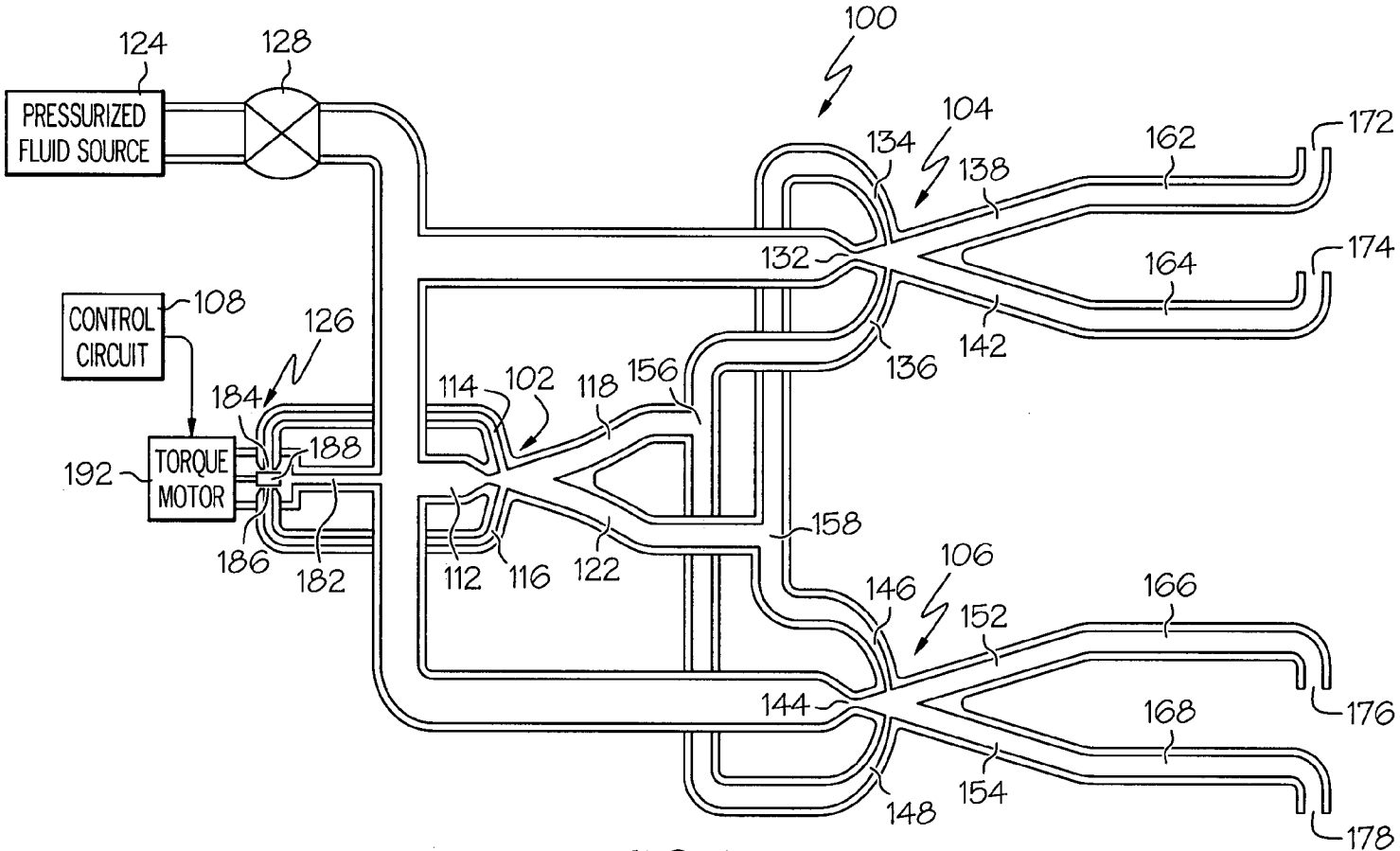
FIG. 1 is a schematic diagram of an exemplary embodiment of the fluidic pulse generator system of the present invention.

Turning now to the description, and with reference first to FIG. 1, a simplified schematic diagram of an exemplary embodiment of a fluidic pulse generator system 100 is shown. The system 100 includes a fluidic pilot valve 102, a first fluidic diverter valve 104, a second fluidic diverter valve 106, and a control circuit 108. The fluidic pilot valve 102 includes an inlet nozzle 112, two control ports 114, 116, and two outlet ports 118, 122. The fluidic pilot valve inlet nozzle 112 is coupled to receive a flow of pressurized fluid from a pressurized fluid source 124 and, due to the configuration of the inlet nozzle 112, accelerates the fluid to supersonic speed.

The two fluidic pilot valve control ports, referred to herein as the first 114 and the second 116 control ports, are each in fluid communication with a control fluid source. In the depicted embodiment, and as will be described more fully below, the control fluid source is pressurized fluid from the pressurized fluid source 124 that flows through a control valve 126. It will be appreciated, however, that the control fluid source could be separate from the system 100. In either case, the pressurized fluid supplied to the fluidic pilot valve 102, via the inlet nozzle 112, is directed through one of the two outlet ports, referred to herein as the first 118 and second 122 outlet ports, depending upon which control port 114, 116 is receiving a flow of control fluid. In particular, if the first control port 114 is receiving the flow of control fluid, then the control fluid deflects the pressurized fluid flowing through the inlet nozzle 112 into and through the second outlet port 122, via the well-known Coanda effect. Conversely, if the second control port 116 is receiving the flow of control fluid, the control fluid deflects the pressurized fluid flowing through the inlet nozzle 112 into and through the first outlet port 118.

Before proceeding with the description of the remainder of the system 100, it is noted that, in the depicted embodiment, the pressurized fluid being supplied to the system 100 is air, and the pressurized fluid source is an aircraft bleed air system (not illustrated). Thus, FIG. 1 additionally depicts a regulating and shut-off valve 128 upstream of the fluidic pulse generator system 100. The regulating and shut-off valve 128 serves at least two functions. First, the valve 128 activates and deactivates the system 100 by turning the flow of pressurized air to the system on and off. Second, the valve 128 limits the pressure of the air supply to the system to a predetermined magnitude. It will be appreciated that a bleed air system is merely exemplary of any one of numerous pressurized fluid sources that may be used to supply a flow of pressurized fluid to the system 100. It will additionally be appreciated that air is merely exemplary of any one of numerous types of fluid that may be supplied to the system 100.

Returning now to the system description, it is seen that the first 104 and second 106 fluidic diverter valves are each constructed similar to the fluidic pilot valve 102. In particular, the first fluidic diverter valve 104 includes an inlet nozzle 132, first 134 and second 136 control ports, and first 138 and second 142 outlet ports. Similarly, the second fluidic diverter valve 106 includes an inlet nozzle 144, first 146 and second 148 control ports, and first 152 and second 154 outlet ports. The first fluidic diverter valve inlet nozzle 132 and the second fluidic diverter valve inlet nozzle 144 are both coupled to receive a flow of pressurized fluid from the pressurized fluid source 124. Similar to the fluidic pilot valve inlet nozzle 112, the first and second fluidic diverter valve inlet nozzles 132, 144 accelerate the fluid to supersonic speed.

The two control ports of both the first 104 and second 106 fluidic diverter valves are each in fluid communication with both of the fluidic pilot valve outlet ports 118, 122. In particular, the first and second fluidic diverter valve second control ports 136, 148 are both in fluid communication with the fluidic pilot valve first outlet port 118, and the first and second fluidic diverter valve first control ports 134,146 are both in fluid communication with the fluidic pilot valve second outlet port 122. Thus, when the pressurized fluid is directed through the fluidic pilot valve first outlet port 118, the pressurized fluid flows to both the first and second fluidic diverter valve second control ports 136, 148. Conversely, when the pressurized fluid is directed through the fluidic pilot valve second outlet port 122, the pressurized fluid flows to both the first and second fluidic diverter valve first control ports 134, 146. It will be appreciated that, although this fluid communication could be implemented using any one of numerous configurations, in the depicted embodiment it is implemented via two "T" fittings. In particular, a first "T" fitting 156 is fluidly coupled between the fluidic pilot valve first outlet port 118 and the first and second fluidic diverter valve second control ports 136, 148, and a second "T" fitting 158 is fluidly coupled between the fluidic pilot valve second outlet port 122 and the first and second fluidic diverter valve first control ports 134, 146.

The first 104 and second 106 fluidic diverter valves operate substantially identical to the fluidic pilot valve 102.

That is, the pressurized fluid supplied to the fluidic diverter valves 104, 106, via the respective inlet nozzles 132, 144, is directed through one of the two outlet ports 138, 142, 152, 154 on each fluidic diverter valve 104, 106, depending upon which control port 134, 136, 146, 148 is receiving the flow of pressurized fluid from the fluidic pilot valve 102. In particular, if the flow of pressurized fluid is directed through the fluidic pilot valve first outlet port 118, then the first and second fluidic diverter valve second control ports 136, 148 each receive the flow of pressurized fluid, which deflects the pressurized fluid flowing through the first and second fluidic diverter valve inlet nozzles 132, 144 into and through the first and second fluidic diverter valve first outlet ports 138, 152. Conversely, if the flow of pressurized fluid is directed through the fluidic pilot valve second outlet port 122, then the first and second fluidic diverter valve first control ports 134, 146 each receive the flow of pressurized fluid, which in turn deflects the pressurized fluid flowing through the first and second fluidic diverter valve inlet nozzles 132, 144 into and through the first and second fluidic diverter valve second outlet ports 142, 154.

The first and second fluidic diverter valve first 138, 152 and second 142, 154 outlet ports are each preferably coupled to a distribution duct.

Specifically, the first fluidic diverter valve first outlet port 138 is coupled to a first distribution duct 162, the first fluidic diverter valve second outlet port 142 is coupled to a second distribution duct 164, the second fluidic diverter valve first outlet port 152 is coupled to a third distribution duct 166, and the second fluidic diverter valve second outlet port 154 is coupled to a fourth distribution duct 162. The distribution ducts 162, 164, 166, 168 communicate the respective fluidic diverter valve 104, 106 output flow to designated points. It will be appreciated that the distribution ducts 162, 164, 166, 168 may be of any appropriate length; though it will be appreciated that dynamic interactions and effects should be considered for operations at higher frequencies with long-length ducts. Each of the distribution ducts 162, 164, 166, 168 includes an outlet port 172, 174, 176, 178, respectively, through which fluid flowing in the duct exits. The outlet ports 172, 174, 176, 178 may be appropriately shaped and configured to provide a desired shaping of the fluid flow upon exit from the distribution ducts 162, 164, 166, 168.

Figure 2:
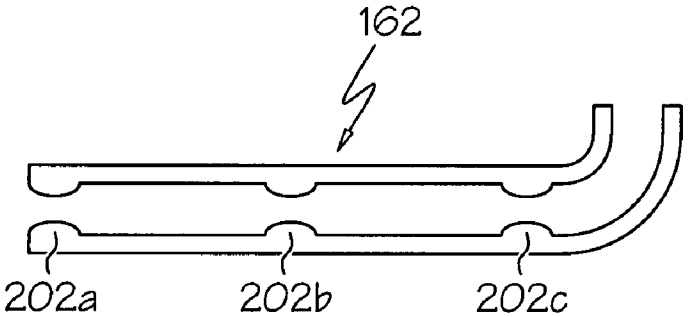
FIG. 2 is a cross section view of an inlet nozzle of an exemplary embodiment of a fluidic amplifier that may be used in the system of FIG. 1.

The distribution ducts 162, 164, 166, 168, as depicted in FIG. 1, have a relatively smooth, continuous inner surface. Although this is one alternative configuration, preferably, the distribution ducts 162, 164, 166, 168 each include one or more flow restrictions therein. For example, as shown in FIG. 2, which is a simplified cross section view of a preferred embodiment of the first distribution duct 162, three flow restrictions 202*a–c* are included. In the depicted embodiment, the flow restrictions 202*a–c* are each smooth converging-diverging elements disposed within the duct 162. It will be appreciated, however, that this is merely exemplary and that other types and shapes of flow restrictions 202 could be used.

The flow restrictions isolate any duct resonance effects from the operation of the first 104 and second 106 fluidic diverter valves. If the flow restrictions 202 are not included, a characteristic resonance frequency, similar to that experienced by an organ pipe or an automobile exhaust pipe, exists in the distribution duct 162. The characteristic frequency is determined by the duct length and acoustic speed within the duct 162. If such a characteristic resonance frequency exists, a reflected pressure wave is developed in the duct 162 that can interfere with the output of the associated fluidic diverter valve 104 or 106 by momentarily forcing the flow from one output ports to the other output port. This phenomenon can manifest itself as either an uncontrollable output frequency, or a poor quality output signal in which several frequencies exist simultaneously.

Returning now to FIG. 1, it was previously mentioned that the source of control fluid to the fluidic pilot valve 102 is pressurized fluid from the pressurized fluid source 124 that flows through a control valve 126. The control valve 126 and its function will now be described. The control valve 126, in the depicted embodiment, is an electro-mechanical element that causes control fluid to be directed to either the fluidic pilot valve first 114 or second 116 control ports. The control valve 126 includes an inlet port 182, a first outlet port 184, a second outlet port 186, and a valve element 188. The control valve inlet port 182 is coupled to receive the flow of pressurized fluid from the pressurized fluid source 124. The control valve first 184 and second 186 outlet ports are in fluid communication with the fluidic pilot valve first 114 and second 116 control ports, respectively.

The valve element 188 is mounted on the control valve 126 and is moveable between a first position and a second position. In the first position, the valve element 188 blocks the control valve first fluid outlet port 184 from the control valve inlet port 182, which allows the control valve inlet port 182 to fluidly communicate with the control valve second outlet port 186. Conversely, in the second position, the valve element 188 blocks the control valve second fluid outlet port 186 from the control valve inlet port 182, which allows the control valve inlet port 182 to fluidly communicate with the control valve first outlet port 184. Thus, when the valve element 188 is in the first position, control fluid is directed to the fluidic pilot valve second control port 116, and when the valve element is in the second position, control fluid is directed to the fluidic pilot valve first control port 114.

The valve element 188 is moved between the first and second positions via a valve actuator 192. The valve actuator 192 may be any one of numerous types of valve actuators, but in the depicted embodiment, a torque motor 192 is used. As FIG. 1 additionally depicts, the torque motor 192 is coupled to the control circuit 108, which is configured to supply valve position command signals. The torque motor 192, in response to the valve position command signals, moves the valve element 188 between the first and second positions. The control circuit 108 may supply the valve position command signals to the torque motor 192 at a set periodicity, or in response to an external input signal (not shown) supplied to the control circuit 108. In a particular preferred embodiment, in which the system is used to supply periodic fluid pressure pulses, the valve command signals are supplied at a set frequency, which would cause the torque motor 192 to move the valve element 188 from the first position, to the second position, and back to the first position at the set frequency. Although various frequencies may be selected, preferably frequencies of 250 Hz or less are used. In a particular implementation, the periodic valve position commands are implemented as a square wave having a desired frequency.

Figure 3:
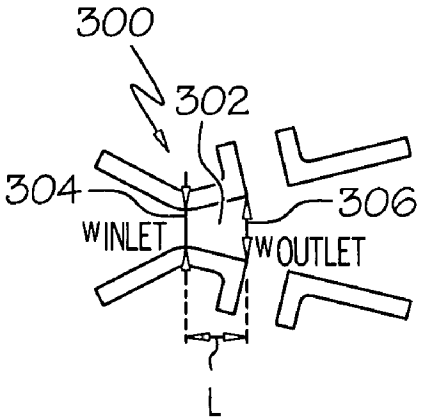
FIG. 3 is a cross section view of a portion of an exemplary exhaust duct that may be used in the system of FIG. 1.

Turning now to FIG. 3, a simplified cross section view of a fluidic amplifier inlet nozzle 300 is shown. It will be appreciated that the inlet nozzle 300 depicted in FIG. 3 is representative of the inlet nozzles in the fluid pilot valve 102, and the first 104 and second 106 fluidic diverter valves. The inlet nozzle 300 includes an expansion section 302, having an inlet 304 and an outlet 306. As shown in FIG. 3, the width of the expansion section inlet 304 is smaller than width of the expansion section outlet 306. It is this configuration that allows the nozzle 300 to accelerate the fluid to supersonic speed, as previously mentioned.

In a particular preferred embodiment, the length (L) of the expansion section 300 in the fluidic pilot valve 102 is longer than the expansion section 300 in the first 104 and second 106 fluidic diverter valves. This may be accomplished in any one of numerous ways, but it is preferably accomplished by making the ratio of the nozzle expansion section outlet width ($w_{outlet}$) to the nozzle expansion section inlet width ($w_{inlet}$) in the fluidic pilot valve 102 greater than the same ratio in the first 104 and second 106 fluidic diverter valves. This configuration is preferred because a suction pressure is created at the first and second fluidic diverter valve control ports 134, 136, 146, 148 when the pressurized fluid flows past the control ports 134, 136, 146, 148. This suction pressure causes a reduced static pressure at the control ports 134, 136, 146, 148, which is also communicated to the fluidic pilot valve outlet ports 118, 122. This causes the fluidic pilot valve 102 to operate at a higher pressure ratio than the first 104 and second 106 fluidic diverter valves.

The fluidic pulse generator system 100 described herein can generate fluid pressure pulses at a desired periodicity, and is configured with a single moving part. As a result, the system 100 is relatively simple, inexpensive, and robust, as compared to current pulse generator systems.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A fluidic pulse generator system for directing a flow of a pressurized fluid, comprising:

a fluidic pilot valve including an inlet nozzle, first and second control ports, and first and second outlet ports, the fluidic pilot valve inlet nozzle adapted to receive the flow of pressurized fluid, and the fluidic pilot valve first and second control ports each adapted to selectively receive a flow of control fluid, the fluidic pilot valve configured, in response to the selective receipt of the flow of control fluid to the fluidic pilot valve first or second control ports, to direct the flow of pressurized fluid received by the fluidic pilot valve inlet nozzle through the fluidic pilot valve second or first outlet port, respectively;

a first fluidic diverter valve including an inlet nozzle, first and second control ports, and first and second outlet ports, the first fluidic diverter valve inlet nozzle adapted to receive the flow of pressurized fluid, the first fluidic diverter valve first and second control ports in fluid communication with the fluidic pilot valve second and first outlet ports, respectively, whereby pressurized fluid flow through the fluidic pilot valve first or second outlet ports directs the flow of pressurized fluid received by the first fluidic diverter valve inlet nozzle through the first fluidic diverter valve first or second outlet ports, respectively; and a second fluidic diverter valve including an inlet nozzle, first and second control ports, and first and second outlet ports, the second fluidic diverter valve inlet nozzle adapted to receive the flow of pressurized fluid, the second fluidic diverter valve first and second control ports in fluid communication with the fluidic pilot valve second and first outlet ports, respectively, whereby pressurized fluid flow through the fluidic pilot valve first or second outlet ports directs the flow of pressurized fluid received by the second fluidic diverter valve inlet nozzle through the second fluidic diverter valve second or first outlet ports, respectively.

2. The system of claim 1, further comprising:

a control valve including an inlet port, and first and second outlet ports in fluid communication with the inlet port, the inlet port adapted to receive the flow of pressurized fluid, the first and second outlet ports in fluid communication with the pilot valve first and second control ports, respectively; and a valve element mounted on the control valve and moveable between a first position, in which the flow of pressurized fluid received by the inlet port is directed out the first outlet port as control fluid, and a second position, in which the flow of pressurized fluid received by the inlet port is directed out the second outlet port as control fluid, whereby the control valve, in response to movement of the valve element between the first and second positions, selectively directs the flow of control fluid to the fluidic pilot valve first and second control ports, respectively.

3. The system of claim 2, further comprising:

a torque motor coupled to the valve element, the torque motor adapted to receive one or more valve position command signals and operable, in response thereto, to move the valve element to either the first or second position.

4. The system of claim 3, further comprising:

a control circuit configured to supply the valve position command signals.

5. The system of claim 4, wherein the control circuit is further configured to supply the valve position command signals at a predetermined rate, to thereby move the valve element between the first and second positions at the predetermined rate.

6. The system of claim 1, further comprising:

a plurality of distribution ducts, each distribution duct in fluid communication with one of the first or second fluidic diverter valve outlet ports.

7. The system of claim 6, further comprising:

one or more flow restrictions disposed within each of the distribution ducts.

8. The system of claim 6, wherein:

each distribution duct includes an outlet port; and each distribution duct outlet port is configured to shape the flow of pressurized fluid therethrough.

9. The system of claim 1, wherein:

each of the inlet nozzles includes an expansion section having a predetermined length; and the predetermined length of the fluidic pilot valve nozzle expansion section is greater than the predetermined length of the first and second fluidic diverter valve inlet nozzle expansion sections.

10. The system of claim 1, further comprising:

an inlet duct having an inlet port configured to receive the flow of pressurized fluid, and an outlet port in fluid communication with the fluidic pilot valve inlet nozzle, to thereby direct the flow of pressurized fluid thereto; and a shut-off valve mounted on the inlet duct, the shut-off valve moveable between at least a closed position, in which the flow of pressurized fluid to the fluidic pilot valve inlet nozzle is prevented, and an open position, in which the flow of pressurized fluid to the fluidic pilot valve inlet nozzle is allowed.

11. A fluidic pulse generator system for directing a flow of a pressurized fluid, comprising:

a fluidic pilot valve having an inlet nozzle, first and second control ports, and first and second outlet ports, the fluidic pilot valve inlet nozzle adapted to receive the flow of pressurized fluid, and the fluidic pilot valve first and second control ports each adapted to selectively receive a flow of control fluid, the fluidic pilot valve configured, in response to the selective receipt of the flow of control fluid to the fluidic pilot valve first or second control ports, to direct the flow of pressurized fluid received by the fluidic pilot valve inlet nozzle through the fluidic pilot valve second or first outlet port, respectively;

a first fluidic diverter valve having an inlet nozzle, first and second control ports, and first and second outlet ports, the first fluidic diverter valve inlet nozzle adapted to receive the flow of pressurized fluid, the first fluidic diverter valve first and second control ports in fluid communication with the fluidic pilot valve second and first outlet ports, respectively, whereby pressurized fluid flow through the fluidic pilot valve first or second outlet ports directs the flow of pressurized fluid received by the first fluidic diverter valve inlet nozzle through the first fluidic diverter valve first or second outlet ports, respectively;

a second fluidic diverter valve having an inlet nozzle, first and second control ports, and first and second outlet ports, the second fluidic diverter valve inlet nozzle adapted to receive the flow of pressurized fluid, the second fluidic diverter valve first and second control ports in fluid communication with the fluidic pilot valve second and first outlet ports, respectively, whereby pressurized fluid flow through the fluidic pilot valve first or second outlet ports directs the flow of pressurized fluid received by the second fluidic diverter valve inlet nozzle through the second fluidic diverter valve second or first outlet ports, respectively;

a control valve having an inlet port, and first and second outlet ports in fluid communication with the inlet port, the inlet port adapted to receive the flow of pressurized fluid, the first and second outlet ports in fluid communication with the pilot valve first and second control ports, respectively; and a valve element mounted at least partially within the valve body and moveable between a first position, in which the flow of pressurized fluid received by the inlet port is directed out the first outlet port as control fluid, and a second position, in which the flow of pressurized fluid received by the inlet port is directed out the second outlet port as control fluid, whereby the control valve, in response to movement of the valve element between the first and second positions, selectively directs the flow of control fluid to the fluidic pilot valve first and second control ports, respectively.

12. The system of claim 11, further comprising:

a torque motor coupled to the valve element, the torque motor adapted to receive one or more valve position command signals and operable, in response thereto, to move the valve element to either the first or second position.

13. The system of claim 12, further comprising:

a control circuit configured to supply the valve position command signals.

14. The system of claim 13, wherein the control circuit is further configured to supply the valve position command signals at a predetermined rate, to thereby move the valve element between the first and second positions at the predetermined rate.

15. The system of claim 11, further comprising:

a plurality of distribution ducts, each distribution duct in fluid communication with one of the first or second fluidic diverter valve outlet ports.

16. The system of claim 15, further comprising:

one or more flow restrictions disposed within each of the distribution ducts.

17. The system of claim 15, wherein:

each distribution duct includes an outlet port; and each distribution duct outlet port is configured to shape the flow of pressurized fluid therethrough.

18. The system of claim 11, wherein:

each of the inlet nozzles includes an expansion section having a predetermined length; and the predetermined length of the fluidic pilot valve nozzle expansion section is greater than or equal to the predetermined length of the first and second fluidic diverter valve inlet nozzle expansion sections.

19. The system of claim 11, further comprising:

an inlet duct having an inlet port configured to receive the flow of pressurized fluid, and an outlet port in fluid communication with the fluidic pilot valve inlet nozzle, to thereby direct the flow of pressurized fluid thereto; and a shut-off valve mounted on the inlet duct, the shut-off valve moveable between at least a closed position, in which the flow of pressurized fluid to the fluidic pilot valve inlet nozzle is prevented, and an open position, in which the flow of pressurized fluid to the fluidic pilot valve inlet nozzle is allowed.

20. A fluidic pulse generator system supplying periodic fluid pressure pulses, comprising:

a control circuit configured to supply the valve position command signals at a predetermined rate;

a fluidic pilot valve having an inlet nozzle, first and second control ports, and first and second outlet ports, the fluidic pilot valve inlet nozzle adapted to receive the flow of pressurized fluid, and the fluidic pilot valve first and second control ports each adapted to selectively receive a flow of control fluid, the fluidic pilot valve configured, in response to the selective receipt of the flow of control fluid to the fluidic pilot valve first or second control ports, to direct the flow of pressurized fluid received by the fluidic pilot valve inlet nozzle through the fluidic pilot valve second or first outlet port, respectively;

a first fluidic diverter valve having an inlet nozzle, first and second control ports, and first and second outlet ports, the first fluidic diverter valve inlet nozzle adapted to receive the flow of pressurized fluid, the first fluidic diverter valve first and second control ports in fluid communication with the fluidic pilot valve second and first outlet ports, respectively, whereby pressurized fluid flow through the fluidic pilot valve first or second outlet ports directs the flow of pressurized fluid received by the first fluidic diverter valve inlet nozzle through the first fluidic diverter valve first or second outlet ports, respectively;

a second fluidic diverter valve having an inlet nozzle, first and second control ports, and first and second outlet ports, the second fluidic diverter valve inlet nozzle adapted to receive the flow of pressurized fluid, the second fluidic diverter valve first and second control ports in fluid communication with the fluidic pilot valve second and first outlet ports, respectively, whereby pressurized fluid flow through the fluidic pilot valve first or second outlet ports directs the flow of pressurized fluid received by the second fluidic diverter valve inlet nozzle through the second fluidic diverter valve second or first outlet ports, respectively;

a control valve having an inlet port, and first and second outlet ports in fluid communication with the inlet port, the inlet port adapted to receive the flow of pressurized fluid, the first and second outlet ports in fluid communication with the pilot valve first and second control ports, respectively;

a valve element mounted at least partially within the valve body and moveable between a first position, in which the flow of pressurized fluid received by the inlet port is directed out the first outlet port as control fluid, and a second position, in which the flow of pressurized fluid received by the inlet port is directed out the second outlet port as control fluid; and a torque motor coupled to the valve element, the torque motor coupled to receive the position command signals and operable, in response thereto, to move the valve element to between the first and second positions at the predetermined rate, whereby the control valve, in response to movement of the valve element between the first and second positions at the predetermined rate, selectively directs the flow of control fluid to the fluidic pilot valve first and second control ports, respectively, at the predetermined rate.

* * * * *